US006108430A

United States Patent [19]

Kurisu

[11] Patent Number: 6,108,430

[45] Date of Patent: Aug. 22, 2000

[54] HEADPHONE APPARATUS

[75] Inventor: Hirofumi Kurisu, Kanagawa, Japan

[73] Assignee: Sony Corporation, Tokyo, Japan

[21] Appl. No.: 09/381,961

[22] PCT Filed: Feb. 2, 1999

[86] PCT No.: PCT/JP99/00425

§ 371 Date: Sep. 30, 1999

§ 102(e) Date: Sep. 30, 1999

[87] PCT Pub. No.: WO99/40756

PCT Pub. Date: Aug. 12, 1999

[30] Foreign Application Priority Data

Feb. 3, 1998 [JP] Japan ..... 8-022217

[51] Int. Cl.[7] ..... H04R 5/02; H04R 1/10

[52] U.S. Cl. ..... 381/310; 381/309; 381/74

[58] Field of Search ..... 381/26, 74, 303, 381/309, 310, 311, 17, 18, FOR 126, 63

[56] References Cited

U.S. PATENT DOCUMENTS

| | | | |
|---|---|---|---|
| 3,962,543 | 6/1976 | Blauert et al. | 381/310 |
| 4,188,504 | 2/1980 | Kasuga et al. | 381/17 |
| 4,218,585 | 8/1980 | Carver | 381/303 |
| 5,173,944 | 12/1992 | Begault | 381/17 |
| 5,181,248 | 1/1993 | Inanaga et al. | 381/310 |
| 5,386,082 | 1/1995 | Higashi | 381/17 |
| 5,438,623 | 8/1995 | Begault | 381/17 |
| 5,452,359 | 9/1995 | Inanaga et al. | 381/310 |
| 5,495,534 | 2/1996 | Inanaga et al. | 381/74 |
| 5,500,900 | 3/1996 | Chen et al. | 381/17 |
| 5,526,429 | 6/1996 | Inanaga et al. | 381/74 |
| 5,687,239 | 11/1997 | Inanaga et al. | 381/309 |
| 5,761,314 | 6/1998 | Inanaga et al. | 381/309 |
| 5,796,843 | 8/1998 | Inanaga et al. | 381/309 |
| 6,021,205 | 2/2000 | Yamada et al. | 381/310 |

FOREIGN PATENT DOCUMENTS

| | | | |
|---|---|---|---|
| 4-44500 | 2/1992 | Japan | 381/74 |
| 5-183998 | 7/1993 | Japan | 381/74 |

*Primary Examiner*—Forester W. Isen
*Assistant Examiner*—Xu Mei
*Attorney, Agent, or Firm*—Jay H. Maioli

[57] ABSTRACT

A signal processing circuit for performing predetermined signal processes to input audio signals of four channels, headphones to which an output signal of the signal processing circuit is supplied, and detecting method for detecting a rotation of the head of the listener are provided. Digital filters for convoluting impulse responses obtained by converting head portion transfer functions from sound sources to the right and left ears into time regions to the input audio signals of four channels, time-difference adding circuits, and level-difference adding circuits are provided in the signal processing circuit. In the adding circuits, a time difference and a level difference of the signals which are transmitted through the adding circuits are controlled in accordance with detection outputs of the detecting method.

13 Claims, 6 Drawing Sheets

3

HEADPHONE APPARATUS

TECHNICAL FIELD

The invention relates to a headphone apparatus for reproducing multichannel audio signals.

BACKGROUND ART

An audio signal in association with a video image such as a movie is divided into multichannel signals and recorded on the assumption that it is reproduced by speakers arranged on both right and left sides of a screen and speakers arranged at right and left back positions or both right and left sides of the listener. According to such a method, the position of a sound source in a video image and the position of an acoustic image which is actually heard coincide and a sound field having a more natural extent is established.

However, if such audio signals are listened to by using headphones, an acoustic image is oriented in the head, the direction of a video image and the orienting position of the acoustic image do not coincide, and the acoustic image is oriented to an extremely unnatural position.

Even in case of listening to music which is not accompanied with a video image or the like, different from the case of reproducing the sound from the speakers, the sound is likewise heard in the head and an unnatural sound field is also reproduced.

Therefore, there is considered a method whereby head portion transfer functions (impulse response) from speakers arranged in front of the listener to the right and left ears of the listener are preliminarily measured or calculated and are convoluted into audio signals by digital filters and the resultant audio signals are supplied to headphones. According to such a method, since an acoustic image is oriented to a position out of the head, a sound field near that in case of reproducing the sound from the speakers can be reproduced.

According to such a method, however, although the acoustic image is oriented to the position out of the head, when the listener changes the direction of the head, since the acoustic image is moved together with the motion of the head, in case of the acoustic image accompanied with a video image, a deviation occurs between the direction of the video image and the direction of the acoustic image and the acoustic image is oriented to an unnatural position.

Therefore, there is further considered a method whereby the motion of the head of the listener is detected and coefficients of digital filters are updated in accordance with the motion of the head and the direction of an acoustic image is fixed for a listening environment. According to such a method, the acoustic image is not oriented into the head and even if the head is moved, the acoustic image is not moved, so that an acoustic image that is substantially equivalent to the acoustic image which is reproduced by the speakers can be obtained.

However, if a process for the movement of the head as mentioned above is performed, according to experiments, although the orientation of the acoustic image becomes sharp and the sense of direction of the sound becomes clear, the sense of surround which surrounds the listener and is a feature of a virtual stereophonic sound field reproducing feeling is lost, so that it is not suitable for the signal to reproduce a virtual stereophonic sound field.

In case of updating the coefficients of the digital filters in accordance with the motion of the head, even if the head is slightly moved, the coefficients of the digital filters have to be immediately updated each time, so that a number of high speed product sum arithmetic operating circuits and memories are necessary. Thus, a circuit scale increases and the system becomes extremely expensive.

The invention intends to solve the problems as mentioned above.

DISCLOSURE OF INVENTION

Therefore, according to the invention, there is provided a headphone apparatus comprising:

a signal processing circuit for performing signal processes to input audio signals of N (N is an integer of 2 or more) channels;

headphones to which an output signal of the signal processing circuit is supplied;

detecting means, provided for the headphones, for detecting a rotation of a head portion of the user of the headphones; and a circuit for outputting control data on the basis of a detection output of the detecting means, wherein the signal processing circuit comprises 2N digital filters for convoluting impulse responses obtained by converting head portion transfer functions from N sound sources provided at positions for orienting those input audio signals to the right and left ears of the listener into time regions to the input audio signals of the N channels, first and second forming means to which outputs of 2M digital filters corresponding to M ($M \leqq N$) channels as front channels among the N channels are inputted and which form outputs on the basis of each of a component of the left channel and a component of the right channel, a first time difference adding circuit to which the output of the first forming means is inputted, a first level difference adding circuit to which an output of the first time difference adding circuit is inputted, a second time difference adding circuit to which the output of the second forming means is inputted, a second level difference adding circuit to which an output of the second time difference adding circuit is inputted, third and fourth forming means to which outputs of 2(N−M) digital filters corresponding to remaining (N−M) channels among the digital filters of the N channels are inputted and which form outputs on the basis of the output of the digital filter of the left channel and the output of the digital filter of the right channel, fifth forming means for forming an output signal on the basis of the output signal of the third forming means and the output signal of the first level difference adding circuit, and sixth forming means for forming an output signal on the basis of the output signal of the fourth forming means and the output signal of the second level difference adding circuit, a control is performed in accordance with the control data which gives a time difference to the first and second time difference adding circuits, a control is performed in accordance with the control data which gives a level difference to the first and second level difference adding circuits, and the output signals of the fifth and sixth forming means are supplied as an output signal of the signal processing circuit to the headphones.

Therefore, the multichannel audio signals are converted into audio signals which are substantially equivalent to those in case of reproduction from speakers and, thereafter, are supplied to the headphones and converted into acoustic sound.

BEST MODE FOR CARRYING OUT THE INVENTION

Figure 1:
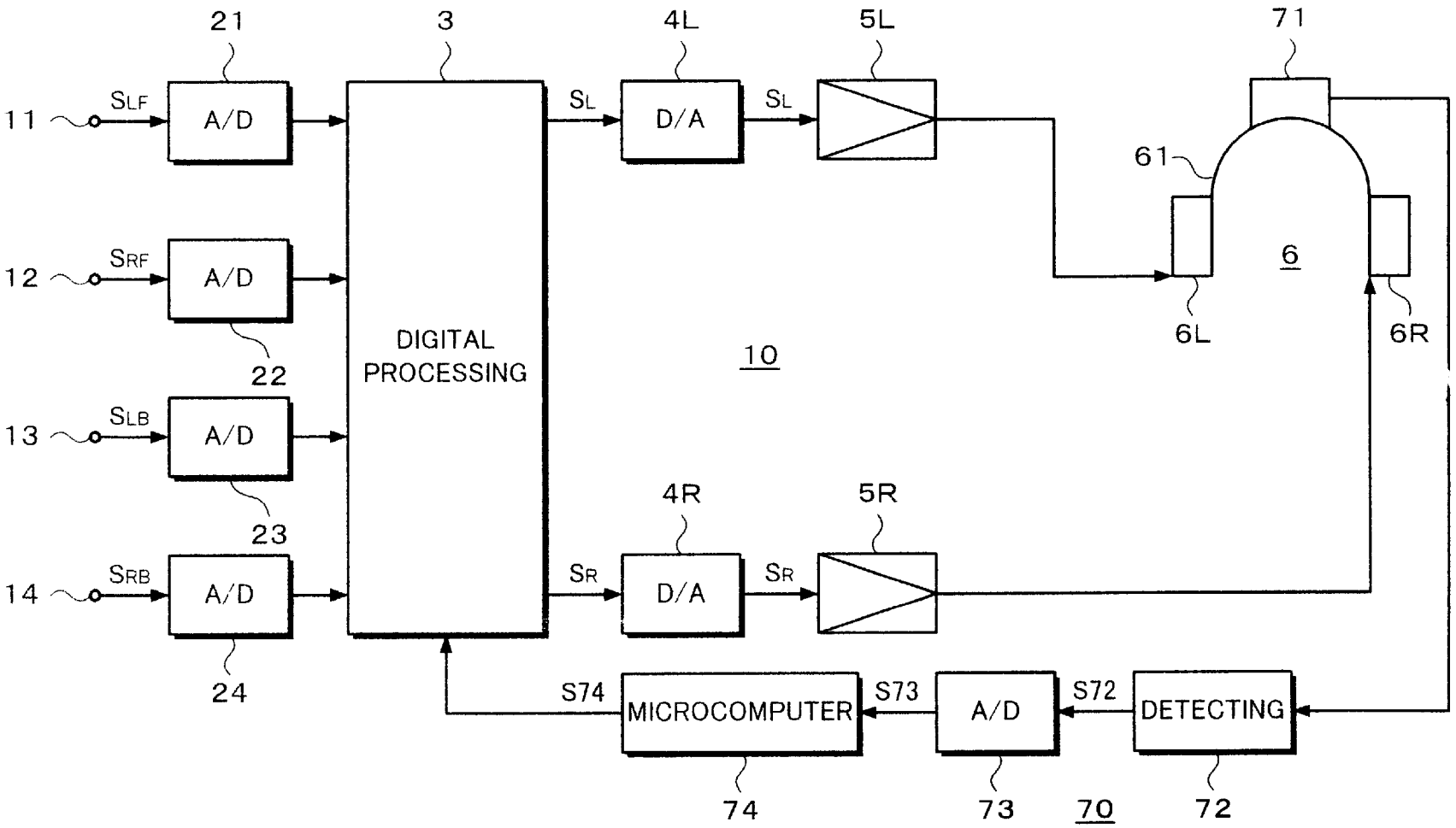
FIG. 1 is a system diagram showing an embodiment of the invention.

FIG. 1 shows an embodiment of a headphone apparatus according to the invention. It is constructed by a headphone adapter 10, headphones 6 to which an output signal of the headphone adapter is supplied, and a detecting circuit 70 of the direction of the head of the listener. Reference characters SLF, SRF, SLB, and SRB denote audio signals of four channels corresponding to the left front, right front, left back, and right back, respectively. When the signals SLF, SRF, SLB, and SRB are supplied to electro/acoustic transducing devices (hereinafter, referred to as acoustic units) 6L (left) and 6R (right) of the headphones of the listener, those signals realize a 4-channel stereophonic reproducing sound field corresponding to that in the case where they are supplied to speakers arranged as if they were arranged at the left front, right front, left back, and right back, respectively.

In the headphone adapter 10, the audio signals SLF to SRB are supplied to A/D converter circuits 21 to 24 through input terminals 11 to 14 and A/D converted. The A/D converted audio signals SLF to SRB are supplied to a digital processing circuit 3 constructed by, for example, a DSP. Although the details of the digital processing circuit 3 will be described hereinafter, it converts the input audio signals into audio signals SL and SR such that even if the audio signals SLF to SRB are reproduced by the headphones 6, a sound field near that in case of reproducing by speakers is obtained (at this time point, although the audio signals SLF to SRB, SL, and SR are digital signals, they are disclosed by regarding them as analog signals because the disclosure will be complicated: the same shall also similarly apply hereinbelow).

The signals SL and SR are supplied to D/A converter circuits 4L and 4R and D/A converted. The D/A converted audio signals SL and SR are supplied to the left and right acoustic units 6L and 6R of the headphones 6 through headphone amplifiers 5L and 5R. The acoustic units 6L and 6R are coupled by a band 61 so as to hold the acoustic units 6L and 6R at the positions of the left and right ears of the listener when the headphones 6 are hung. Further, the head direction detecting circuit 70 is constructed as follows. That is, a rotational angle sensor 71 is attached to, for example, the band 61 of the headphones 6. An output signal of the sensor 71 is supplied to a detecting circuit 72 and an angular velocity when the listener rotates the head is detected. A detection signal S72 is supplied to an A/D converter circuit 73 and A/D converted to a digital detection signal S73. The A/D converted detection signal S72 is supplied to a microcomputer 74.

In the microcomputer 74, after the detection signal S72 was sampled at every predetermined times, it is integrated and converted into data of an angle showing the direction of the head of the listener. A control data signal S74 to actually orient an acoustic image is formed from the angle data. The signal S74 is supplied as a control signal to the digital processing circuit 3.

The digital processing circuit 3 will now be described. The case where the digital processing circuit 3 is constructed by a discrete circuit will be explained here.

Figure 2:
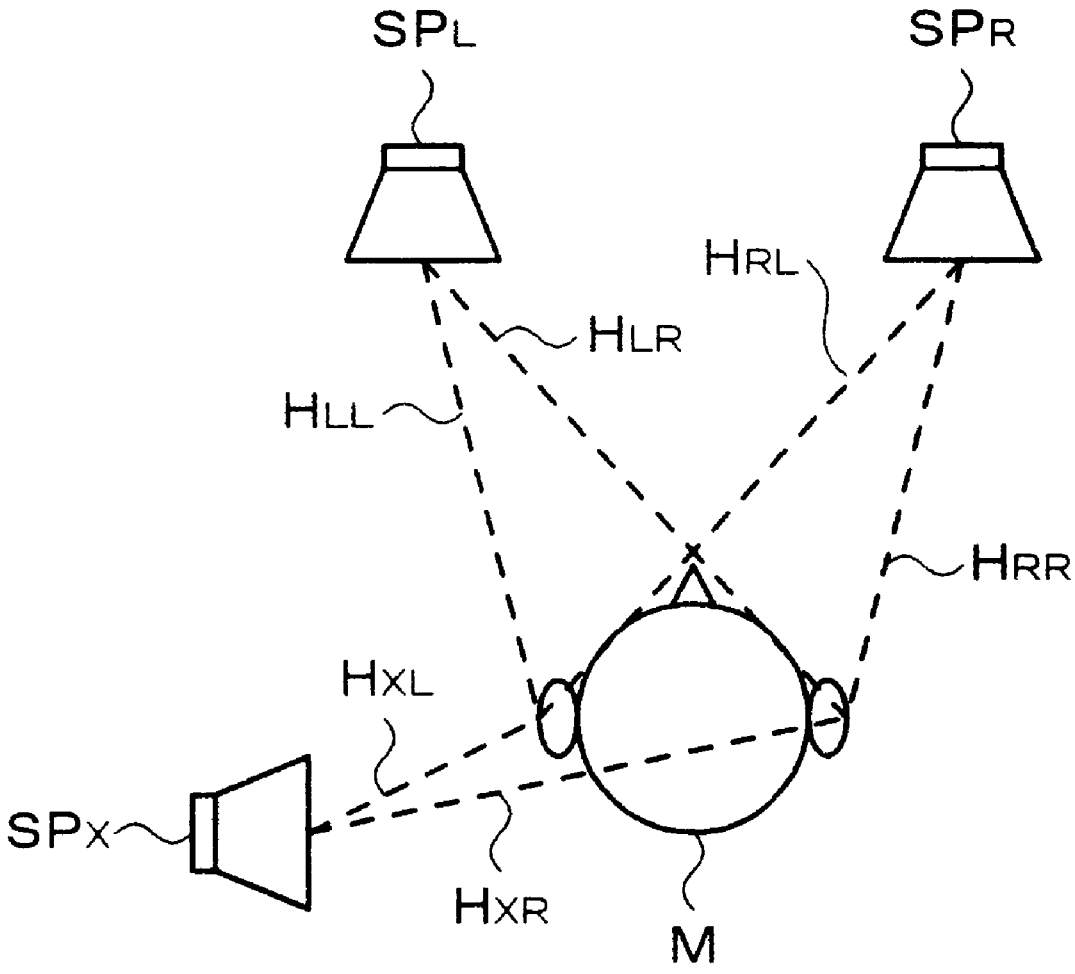
FIG. 2 is a plan view for explaining the invention.

As shown in FIG. 2, there is now considered a case where sound sources SPL and SPR are arranged at the left front side and the right front side of a listener M and a sound source SPX is equivalently reproduced at an arbitrary position out of the head by the sound sources SPL and SPR. Now assuming that HLL: transfer function starting from the sound source SPL and reaching the left ear of the listener M;

HLR: transfer function starting from the sound source SPL and reaching the right ear of the listener M;

HRL: transfer function starting from the sound source SPR and reaching the left ear of the listener M;

HRR: transfer function starting from the sound source SPR and reaching the right ear of the listener M;

HXL: transfer function starting from the sound source SPX and reaching the left ear of the listener M;

HXR: transfer function starting from the sound source SPX and reaching the right ear of the listener M;

the sound sources SPL and SPR can be expressed by $$SPL\ (HXL\times HRR-HXR\times HRL)/(HLL\times HRR-HLR\times HRL)\times SPX \quad (1)$$

$$SPR\ (HXR\times HLL-HXL\times HLR)/(HLL\times HRR-HLR\times HRL)\times SPX \quad (2)$$

Therefore, by supplying an input audio signal SX corresponding to the sound source SPX to the speaker arranged at the position of the sound source SPL through a filter to realize a transfer function portion of the equation (1) and by supplying the signal SX to the speaker arranged at the position of the sound source SPR through a filter to realize a transfer function portion of the equation (2), an acoustic image by the audio signal SX can be oriented at the position of the sound source SPX.

Figure 3:
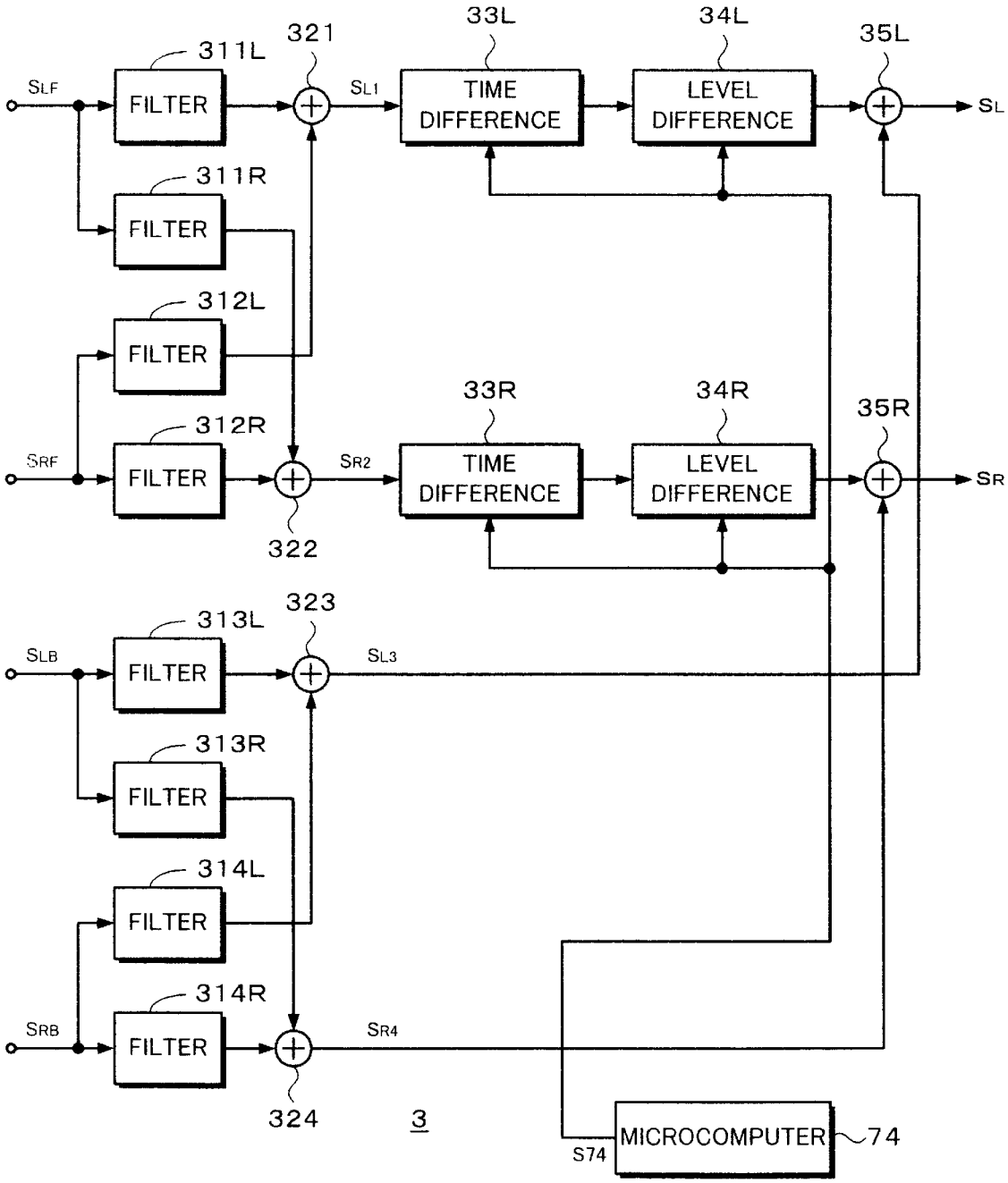
FIG. 3 is a system diagram showing an embodiment of a circuit which can be used in the invention.

Therefore, for example, as shown in FIG. 3, the digital processing circuit 3 can be constructed by digital filters 311L to 314L and 311R to 314R of the FIR type, time difference adding circuits 33L and 33R, level difference adding circuits 34L and 34R, and the like.

That is, the audio signals SLF and SRF from the A/D converter circuits 21 and 22 are supplied to adding circuits 321 and 322 through the digital filters 311L and 312R and supplied to the adding circuits 322 and 321 through the digital filters 311R and 312L, respectively. In this instance, the transfer functions of the digital filters 311L to 312R are set to predetermined values in accordance with the foregoing idea. Impulse responses obtained by converting transfer functions similar to the transfer function portions of the equations (1) and (2) into the time base are convoluted to the audio signals SLF and SRF. Signals as processing results are taken out from the adding circuits 321 and 322 as audio signals SL1 and SR2 of the left front and right front channels, respectively.

The audio signals SL1 and SR2 are supplied to adding circuits 35L and 35R through the time difference adding circuits 33L and 33R and level difference adding circuits 34L and 34R.

The audio signals SLB and SRB from the A/D converter circuits 23 and 24 are supplied to adding circuits 323 and 324 through the digital filters 313L and 314R and supplied to adding circuits 324 and 323 through the digital filters 313R and 314L, respectively. At this time, the transfer functions of the digital filters 313L to 314R are set to predetermined values in accordance with the foregoing idea. Impulse responses obtained by converting transfer functions similar to the transfer function portions of the equations (1) and (2) into the time base are convoluted to the audio signals SLB and SRB. Signals as processing results are taken out from the adding circuits 323 and 324 as audio signals SL3 and SR4 of the left back and right back channels, respectively. The audio signals SL3 and SR4 are supplied to the adding circuits 35L and 35R.

In the adding circuit 35L, the signal SL1 of the left front channel and the signal SL3 of the left back channel are added and the signal SL of the left channel is extracted. In the adding circuit 35R, the signal SR2 of the right front channel and the signal SR4 of the right back channel are added and the signal SR of the right channel is extracted. The signals SL and SR are supplied to the acoustic units 6L and 6R of the headphones 6 as shown in FIG. 1.

Therefore, when the audio signals SL and SR are supplied to the headphones 6, an acoustic image that is almost equivalent to that when the audio signals SLF to SRB are supplied to four speakers is reproduced and a reproduction sound field that is substantially equal to that in case of four speakers is realized.

Since the coefficients of the digital filters 311L to 314R are fixed, the orienting position of the acoustic image reproduced by the headphones 6 is fixed for the listener M in case of using only the above construction. If the listener M moves the head, the acoustic image also moves together as mentioned above.

Therefore, as mentioned above, the detecting circuit 70 is provided and time differences and level differences to be added by the adding circuits 33L to 34R are controlled by the signal S74 from the microcomputer 74. That is, the adding circuits 33L and 33R are constructed by, for example, variable delay circuits and the adding circuits 34L and 34R are constructed by, for example, variable gain circuits.

For example, when there is a sound source at a position in front of the listener M, if the listener M turns to the right, a time delay of an acoustic wave entering the left ear decreases and the level increases. Thus, the characteristics of the adding circuit 33L are controlled as shown by a polygonal line B in FIG. 4 and the characteristics of the adding circuit 34L are controlled as shown by a curve C in FIG. 5. Since the positions of the right and left ears are opposite, the characteristics of the adding circuit 33R are controlled as shown by a polygonal line A in FIG. 4 and the characteristics of the adding circuit 34R are controlled as shown by a curve D in FIG. 5. Coefficients of the digital filters 311L to 314R are fixed to values at the time when the listener M faces the front side.

Figure 4:
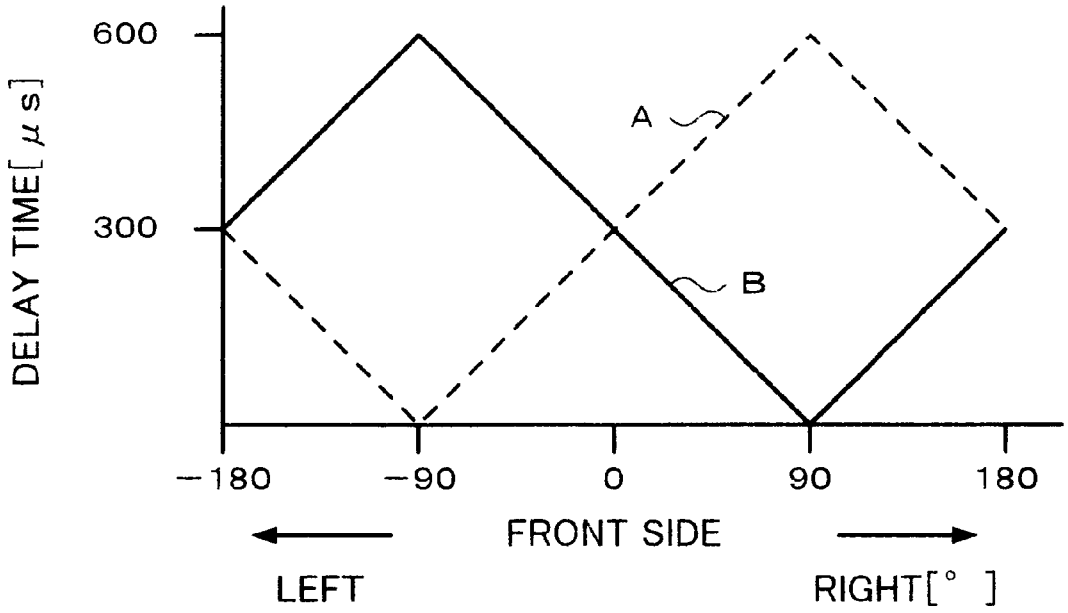
FIG. 4 is a characteristics diagram for explaining the invention.
Figure 5:
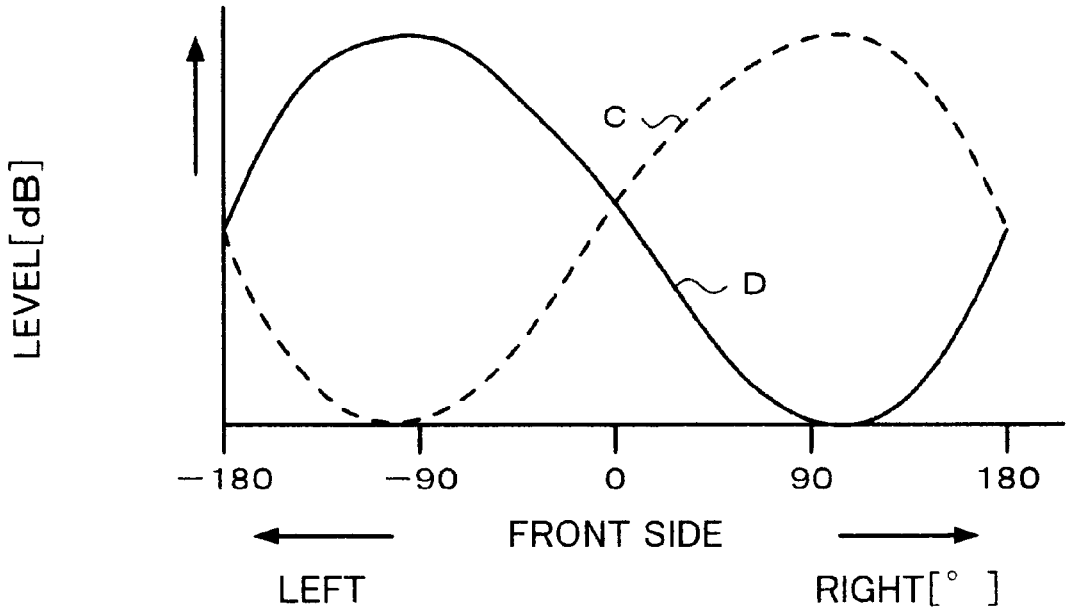
FIG. 5 is a characteristics diagram for explaining the invention.

Therefore, when the listener M changes the direction of the head, the time difference and level difference of the signals SL1 and SR2 of the front channel change as shown in FIGS. 4 and 5 in correspondence to the direction of the head. Thus, an acoustic image which is oriented to the position in front of the listener M in the acoustic image that is formed by the headphones 6 is oriented to an external fixed position irrespective of the direction of the head.

Although the processes of the time difference and level difference relative to the motion of the head are not performed to the signals SL3 and SR4 of the back channel, it is relatively easier to orient the acoustic image to a position behind the listener M as compared with the case of orienting the acoustic image to a position in front of the listener M. The acoustic image can be oriented to a position behind the position out of the head only by convoluting the impulse responses to the signals SL3 and SR4 by the digital filters 313L to 314R. Therefore, as for the processes of the signals SL3 and SR4 of the back channel, the processes of the time difference and the level difference can be omitted, so that the acoustic image can be oriented to the position behind the position out of the head of the listener M without losing the sense of surround.

Further, in the headphone apparatus, since the change of the coefficients of the digital filters 311L to 312R relative to the motion of the head is substituted or simulated by the change in time difference and level difference for the audio signals SL1 and SL2, the circuit scale can be remarkably simplified and the increase in costs can be suppressed.

Figure 6:
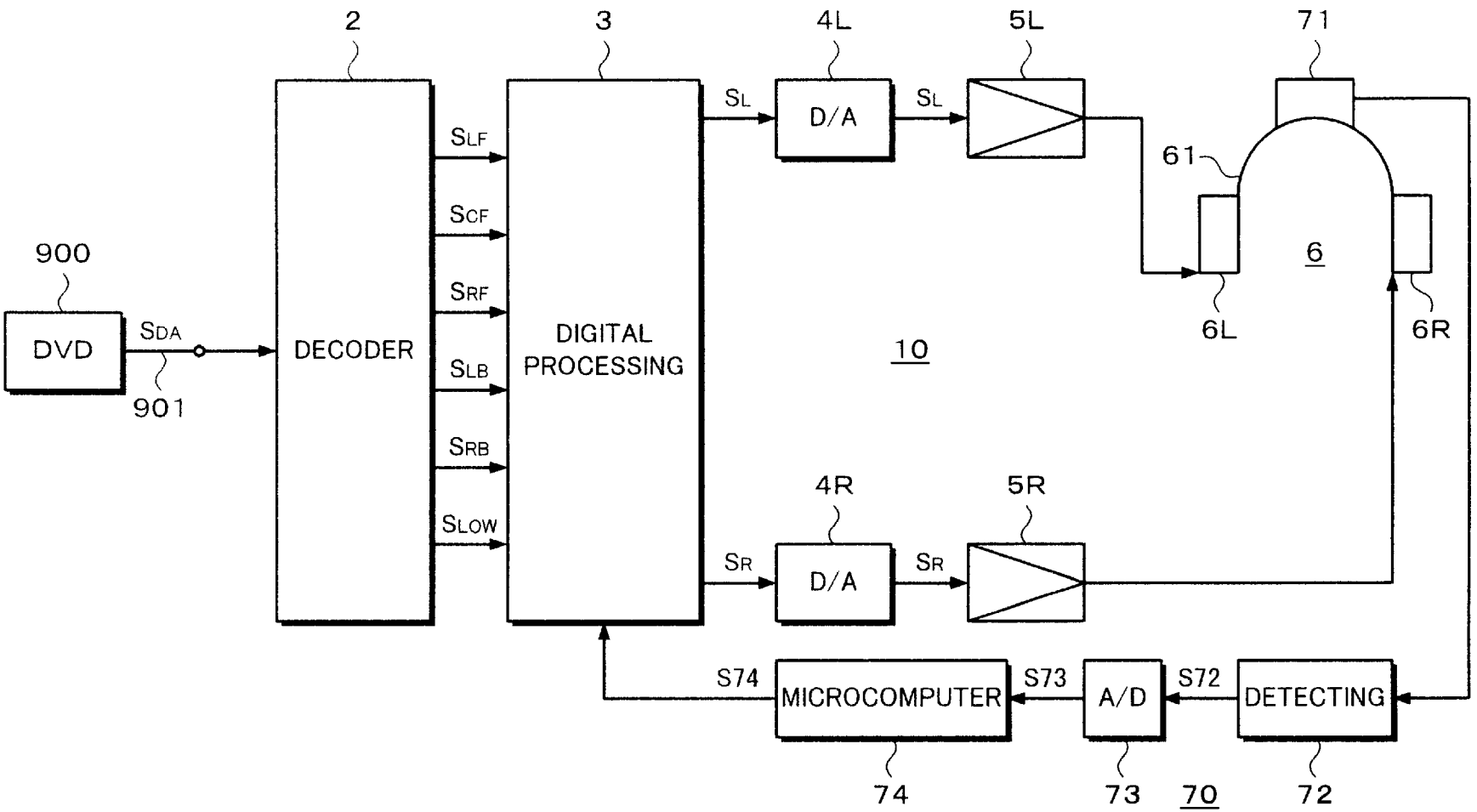
FIG. 6 is a system diagram showing another embodiment of the invention.

FIG. 6 shows the case where the headphone apparatus can be connected to multichannel audio signal sources.

That is, in FIG. 6, reference numeral 900 denotes a digital audio signal source and, in the embodiment, the signal source 900 is a DVD player. A digital audio signal SDA of what is called 5.1 channels in, for example, Dolby Digital (AC-3) is extracted from the DVD player 900.

The digital audio signal SDA is a signal in which digital audio signals SLF, SCF, SRF, SLB, SRB, and SLOW of six channels of left front, center front, right front, left back, right back, and low band of 120 Hz or lower have been encoded into one serial data (bit stream). Generally, the signal SDA is supplied to a dedicated adapter and decoded and D/A converted to the original audio signals SLF to SLOW of six channels and the signals SLF to SLOW are supplied to the respective speakers, thereby forming a reproduction sound field.

The signal SDA is supplied from the player 900 to a decoder circuit 2 of the headphone apparatus through a coaxial cable 901 and decoded to the audio signals SLF to SLOW. The audio signals SLF to SLOW are supplied to the digital processing circuit 3.

Figure 7:
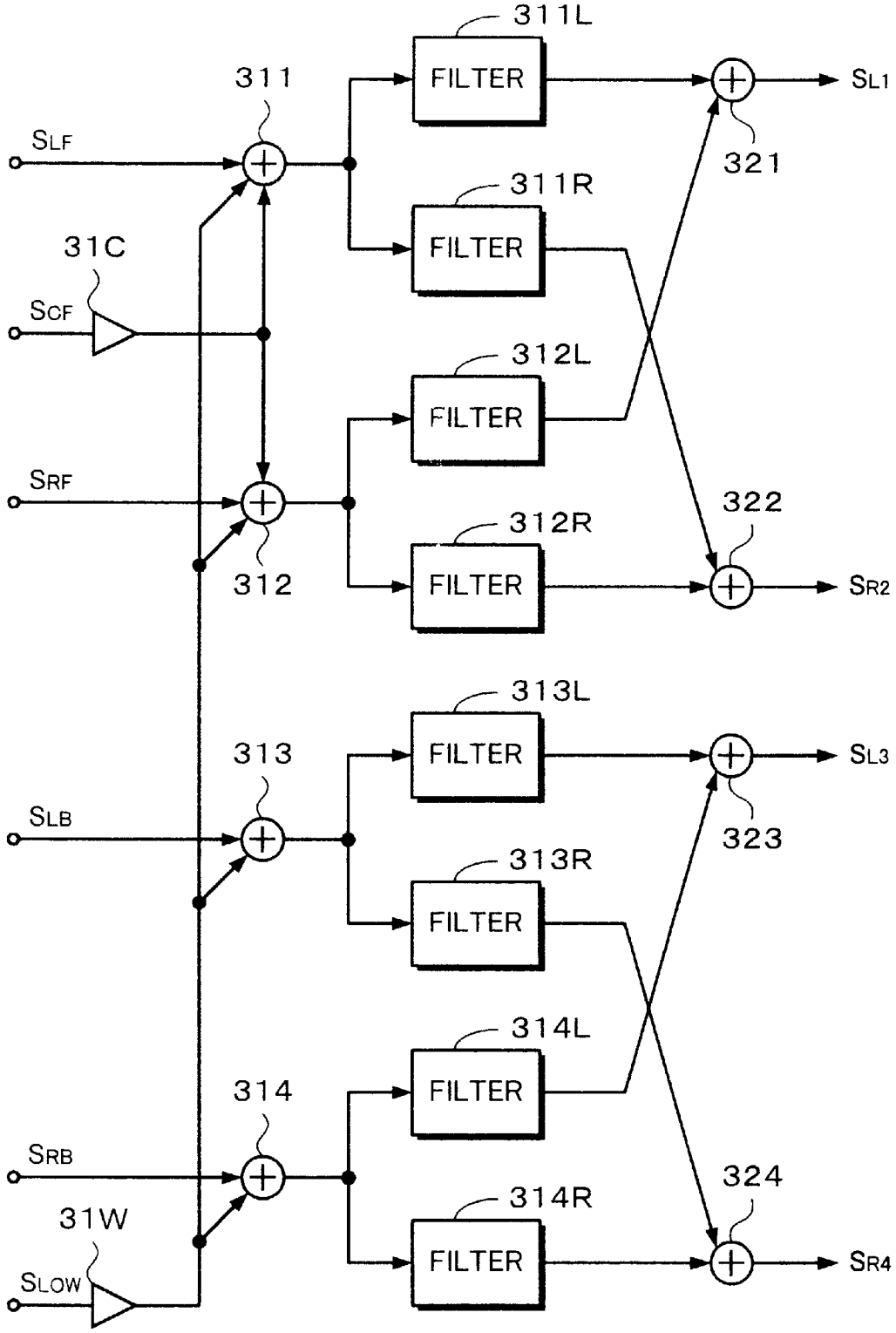
FIG. 7 is a system diagram showing a part of another embodiment of the invention.

If the digital processing circuit 3 is constructed by a discrete circuit, it is constructed as shown in, for example, FIG. 7. That is, an acoustic image which is reproduced by supplying the audio signal SCF of the center front channel to the speaker of the center front can be reproduced by the speakers of the left front and right front. Since a frequency of the audio signal SLOW of the low band channel is low, an acoustic image which is formed by the signal SLOW is not generally accompanied with the sense of direction.

In the processing circuit 3 shown in FIG. 7, therefore, the digital audio signals SLF and SRF from the decoder circuit 2 are supplied to the digital filters 311L to 312R through adding circuits 311 and 312, the digital audio signal SCF from the decoder circuit 2 is supplied to the adding circuits 311 and 312 through an attenuating circuit 31C, and the audio signal SCF is distributed to the audio signals SLF and SRF.

The digital audio signals SLB and SRB from the decoder circuit 2 are supplied to the digital filters 313L to 314R through adding circuits 313 and 314, the digital audio signal SLOW from the decoder circuit 2 is supplied to the adding circuits 311 to 314 through an attenuating circuit 31W, and the audio signal SLOW is distributed to the audio signals SLF to SRB. The post stage from the filters 311L to 314R is constructed in a manner similar to that in FIG. 3.

Therefore, according to the headphone apparatus, a sound field that is almost equivalent to that obtained when the audio signals SLF to SLOW of six channels are supplied to six speakers can be reproduced by the headphones 6.

In this case, it is sufficient to use one cable 901 to connect the DVD player 900 and the headphone apparatus and the connection is simple. Since the digital audio signal SDA reproduced by the DVD player 900 is not D/A converted into the analog audio signal but is supplied as it is to the headphone apparatus and the sound field reproduction is realized, the deterioration in sound quality can be avoided.

In the above description, the rotational angle sensor 71 to detect the direction of the head of the listener M can be constructed by a piezoelectric vibration gyroscope or an earth magnetism azimuth sensor. Or, by arranging light emitting means to a position in front of or around the listener M and attaching at least two light intensity sensors to the headphones 6, the rotational angle of the head of the listener M can be calculated by a ratio of outputs of the light intensity sensors.

A burst-like ultrasonic wave which is generated from an ultrasonic oscillator arranged at the position in front of or around the listener M is received by ultrasonic sensors arranged at two separate positions on the headphones 6 and converted into reception signals and the rotational angle of the headphones 6 can be calculated from a time difference of the reception signals.

What is claimed is:

1. A headphone apparatus comprising:

a signal processing circuit for performing signal processes to input audio signals of N channels where N is an integer of 2 or more;

headphones to which an output signal of said signal processing circuit is supplied;

detecting means for said headphones for detecting a rotation of a head of a user of said headphones; and a circuit for outputting control data based on a detection output of said detecting means, wherein said signal processing circuit includes:

2N digital filters for convoluting impulse responses obtained by converting head transfer functions from N sound sources provided at positions for orienting said input audio signals to right and left ears of a listener into time regions to said input audio signals of said N channels, first and second forming means to which said outputs of 2M digital filters corresponding to M ($M \leqq N$) channels as front channels among said N channels are inputted for forming outputs based on each of a component of a left channel and a component of a right channel, a first time difference adding circuit to which an output of said first forming means is inputted, a first level difference adding circuit to which an output of said first time difference adding circuit is inputted, a second time difference adding circuit to which an output of said second forming means is inputted, a second level difference adding circuit to which an output of said second time difference adding circuit is inputted, third and fourth forming means to which outputs of 2 (N−M) digital filters corresponding to remaining (N−M) channels among the digital filters of said N channels are inputted for forming outputs based on said output of said digital filter of said left channel and said output of said digital filter of said right channel, fifth forming means for forming an output signal based on said output signal of said third forming means and on said output signal of said first level difference adding circuit, and sixth forming means for forming an output signal based on the output signal of said fourth forming means and said output signal of said second level difference adding circuit, wherein a first control is performed with said control data giving a time difference to said first and said second time difference adding circuits, a second control is performed with said control data which gives a level difference to said first and said second level difference adding circuits, and said output signals of said fifth and sixth forming means are supplied as said output signal of said signal processing circuit to said headphones.

2. The apparatus according to claim 1, wherein said input audio signals are obtained by converting multichannel signals into signals of two channels, and a circuit for converting said input audio signals into said multichannel audio signals is provided at a front stage of said signal processing circuit.

3. The apparatus according to claim 1, wherein said input audio signals are obtained by converting said multichannel audio signals into said signals of two channels and audio compressing and digitizing said two-channel signals, and said circuit for converting said input audio signals into said multichannel audio signals is provided at said front stage of said signal processing circuit.

4. The apparatus according to claim 1, wherein said input audio signals are obtained by converting audio signals of six channels into said signals of two channels, and said circuit for converting said input audio signals into said six-channel audio signals is provided at said front stage of said signal processing circuit.

5. The apparatus according to claim 1, wherein said input audio signals are obtained by converting said audio signals of six channels into said signals of two channels and audio compressing and digitizing said two-channel signals, and said circuit for converting said input audio signals into said six-channel audio signals is provided at said front stage of said signal processing circuit.

6. The apparatus according to claim 1, wherein said input audio signals are said signals obtained by converting said audio signals of four channels into said signals of two channels, and said circuit for converting said input audio signals into said four-channel audio signals is provided at said front stage of said signal processing circuit.

7. The apparatus according to claim, 1 wherein said input audio signals are obtained by converting said audio signals of four channels into said signals of two channels and audio compressing and digitizing said two-channel signals, and said circuit for converting said input audio signals into said four-channel audio signals is provided at said front stage of said signal processing circuit.

8. The apparatus according to claim 1, wherein said input audio signals are obtained by converting multichannel audio signals into a signal of one channel, and said circuit for converting said input audio signals into said multichannel audio signals is provided at said front stage of said signal processing circuit.

9. The apparatus according to claim 1, wherein said input audio signals are said signal obtained by converting said signals of six channels into said signal of one channel, and said circuit for converting said input audio signals into said six-channel audio signals is provided at said front stage of said signal processing circuit.

10. The apparatus according to claim 1, wherein said input audio signals are said signal obtained by converting said audio signals of four channels into said signal of one channel, and said circuit for converting said input audio signals into said four-channel audio signals is provided at said front stage of said signal processing circuit.

11. The apparatus according to claim 1, wherein said detecting means for detecting a rotational angle of said head of said user of said headphones comprises a rotational angle sensor attached at a position of said head of said user of said headphones, and said rotational angle is detected by said rotational angle sensor.

12. The apparatus according to claim 1, wherein said detecting means for detecting a rotational angle of said head of said user of said headphones comprises a light emitting unit arranged around said user of said headphones and two or more light intensity sensors attached at positions of said head of said user, and a light emitted from said light emitting unit is received by said light intensity sensors and said rotational angle is detected by a difference between output signals of said light intensity sensors.

13. The apparatus according to claim 1, wherein said detecting means for detecting said rotational angle of said head of said user of said headphones comprises an ultrasonic oscillator arranged at a remote position, and ultrasonic sensors attached at two positions of said head of said user, and a burst-like ultrasonic output generated from said ultrasonic oscillator is received by said ultrasonic sensor and converted into reception signals and said rotational angle is detected by a time difference of said reception signals.

* * * * *